United States Patent [19]

Nagase et al.

[11] 4,108,416

[45] Aug. 22, 1978

[54] DEVICE FOR ADJUSTING LENGTH OF GAS SPRING

[75] Inventors: Toshiro Nagase, Sagamihara; Susumu Hatakeyama, Yokohama, both of Japan

[73] Assignee: Tokico Ltd, Kawasaki, Japan

[21] Appl. No.: 721,820

[22] Filed: Sep. 9, 1976

[30] Foreign Application Priority Data

Sep. 17, 1975 [JP] Japan ..... 50-127793[U]

[51] Int. Cl.[2] ..... A47C 3/22

[52] U.S. Cl. ..... 248/400; 267/131; 267/120

[58] Field of Search ..... 267/131, 124, 120; 268/159, 161, 162, 400; 297/337, 339

[56] References Cited

U.S. PATENT DOCUMENTS

| | | | |
|---|---|---|---|
| 3,788,587 | 1/1974 | Stemmler | 248/400 |
| 3,921,952 | 11/1975 | Wirges | 248/400 |
| 4,022,411 | 5/1977 | Rumsey | 248/400 |

*Primary Examiner*—James B. Marbert

*Attorney, Agent, or Firm*—Schmidt, Johnson, Hovey & Williams

[57] ABSTRACT

A device for adjusting the length of a gas spring is disclosed. This device includes an operating lever pivotally supported on a bracket rigid with the outer peripheral surface of the body proper of a gas spring. The operating lever has an outer end portion suited for operation, and an inner end portion inserted in the body proper of the gas spring. The device further includes a length-adjusting valve for the gas spring, which valve is actuated by the inner end portion of the operating lever, when the operating lever is operated by moving its outer end portion.

1 Claim, 4 Drawing Figures

Fig. 3-A
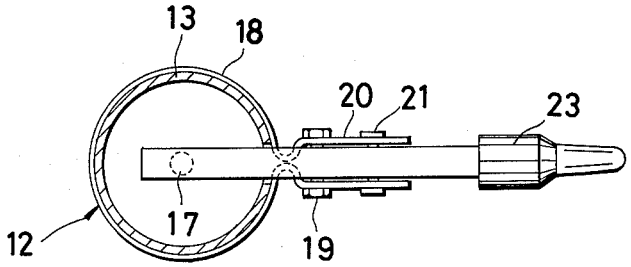
Fig. 3-B
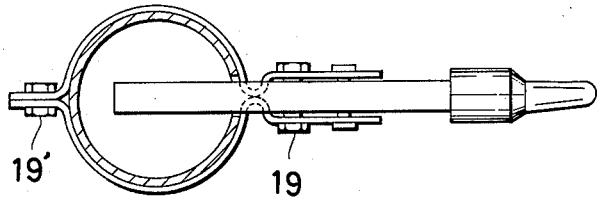

DEVICE FOR ADJUSTING LENGTH OF GAS SPRING

BACKGROUND OF THE INVENTION:

This invention relates to a length-adjusting device for use with a gas spring, and more particularly to a length-adjusting device which is capable of adjusting length accurately by operating an operating lever directly coupled to the gas spring.

A length-adjusting device for use with a gas spring which serves as a support of a chair is known and adjusts the height of a seat of the chair to any desired position in non-step fashion.

As is known to those skilled in the art, gas springs are classified into a single cylinder type and a double-cylinder type having inner and outer cylinders. The construction of the double-cylinder type gas spring of the prior art is as described below.

An inner cavity defined by an inner cylinder and an outer cavity defined by the inner cylinder and outer cylinder are communicated with each other by way of communicating means which are provided in the top and bottom portions or at the left and right ends, and a length-adjusting valve is provided in one of said communicating means, so as to open and close the latter. The gas spring is filled with high pressure gas and liquid, while a rod integral with a piston adapted to slide within the inner cavity, and the outer periphery of the outer cylinder are attached to a stationary member and a movable member, or to a movable member and a stationary member, respectively. If the length-adjusting valve is maintained closed, no movement of liquid within respective cavities through the communicating means takes place, thereby holding the movable member in place. When the valve is open, the gas is free to move, thereby permitting the movable member to shift to a desired position.

On the other hand, in the single cylinder type gas spring, gas and liquid are both charged in a single cylinder, and a piston having a rod projecting from the cylinder is inserted in the oil portion. A partition wall is provided in the oil portion so as not to interfere with the sliding motion of the piston, so that the oil portion is vertically partitioned into a liquid chamber in which the piston is inserted, and a gas chamber. The partition wall is provided with a passage so these upper and lower chambers are in communication with each other, and has a length-adjusting valve for opening and closing the passage, so as to adjust the length of the gas spring.

An example of a known gas spring applied to a chair for adjusting the height of the seat is shown in FIG. 1 for reference purposes. As is obvious from FIG. 1, it has been a common practice that a lever for operating a length-or height-adjusting valve 5 is pivotally mounted on a bracket 3 which is rigidly secured beforehand by, for example, welding to a seat-supporting member 2 of a seat 1, because of ease of assembly. Because of the construction described, the gas spring shown as a known example has many drawbacks in that, upon assembly of a hydraulic spring 7 to the seat 1, there is left excessive clearance at a contacting point 6 between the operating lever 4 and the height-adjusting valve 5 of the spring, or both members are positioned too closely to each other, thus causing jamming in an adjusting operation, or there incurs an error to a greater extent to the stroke of an operating lever. In addition, when the case comes to the worst condition, an intended operation can not be achieved. The use of a welding process as means for fixing the bracket 3 to the seat-backing member 2 of the seat 1 incurs an increased manufacturing cost. In order to eliminate any error in assembly, respective parts particularly the bracket must be disposed in position with high accuracy.

SUMMARY OF THE INVENTION

It is accordingly an object of the present invention to provide a device for adjusting the length of a gas spring, which is simple in construction and free from the above-described drawbacks of known devices.

There is provided a device for adjusting the length of a gas spring according to the present invention, which comprises: an operating lever pivotally mounted on a bracket rigid with the outer peripheral portion of a body proper of the gas spring, said operating lever having an outer end portion for operation and an inner end inserted in the body proper of said gas spring; and, a valve for adjusting a length of a gas spring, said valve being actuated by said inner end of said operating lever, when said operating lever is operated with the outer end portion.

The object and other features of the present invention will be apparent from a reading of the ensuing part of the specification of the invention, in conjunction with the accompanying drawings which indicate a preferred embodiment of the invention.

BRIEF DESCRIPTION OF THE DRAWINGS:

FIG. 3A is a cross-sectional view taken along the line III—III of FIG. 2, showing a position of the operating lever relative to a bracket and a body proper of the gas spring; and FIG. 3B is a modification of FIG. 3A.

DESCRIPTION OF PREFERRED EMBODIMENT:

There is shown in this specification a case where the device according to the present invention is applied to a chair for adjusting the height of its seat to any desired vertical position in non-step fashion. The embodiment to be described below is given in no limitative sense.

The device of the present invention finds adaptability to a horizontally movable device, a rear body of a motor vehicle, a material transporting device, or like devices or machineries.

Figure 1:
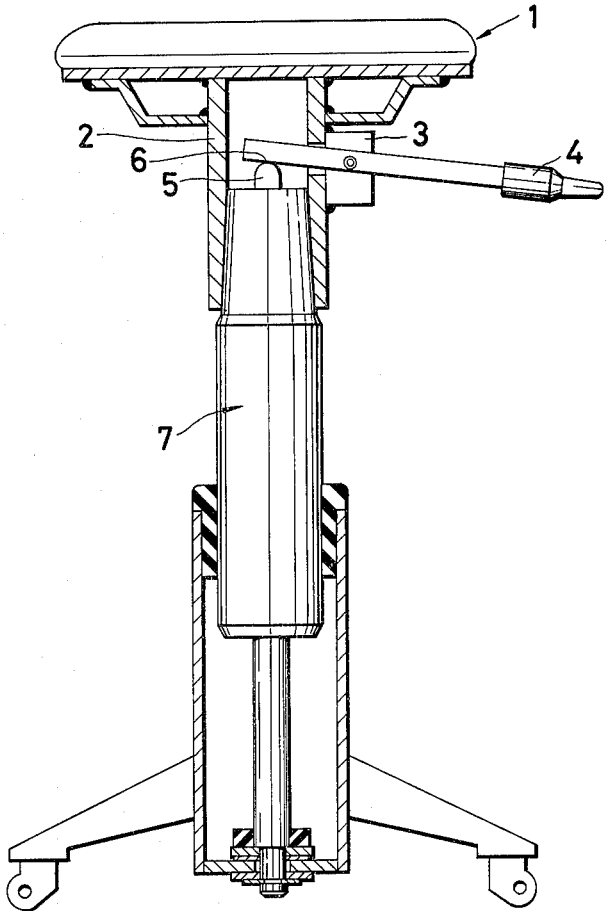
FIG. 1 is a longitudinal cross-sectional view of a known device.
Figure 2:
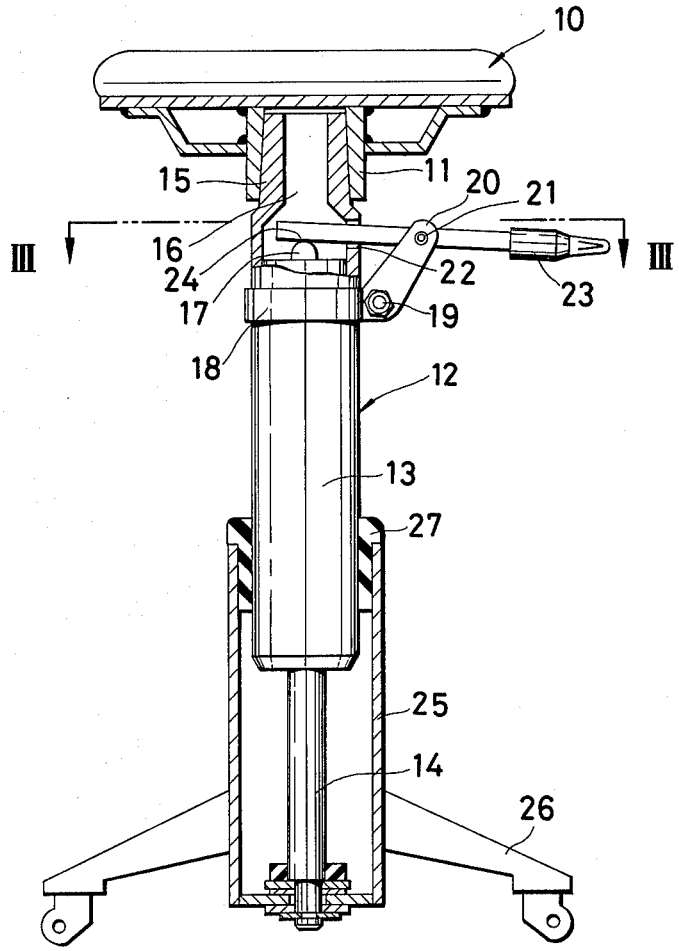
FIG. 2 is a longitudinal cross-sectional view of a device embodying the present invention.

Referring to FIG. 2, shown at 12 is a body proper of a liquid spring serving as a stem of a chair, and at 14 a rod integral with a piston (not shown) slidingly movable within an inner cavity (not shown). The rod 14 has a lower end fixed through the mediary of any proper supporting device 25 to legs 26. The body proper 12 has in its upper portion a coupling portion 15 formed integrally therewith, the coupling portion 15 having an inner cavity 16. A seat-supporting member 11 welded in desired fashion to a seat 10 is fitted on an outer periphery of the coupling portion 15.

The body proper 12 has an outer peripheral portion 13 slidably supported by means of a proper supporting member 27 serving as a guide. A bracket 18 is fastened around the upper outer peripheral surface 13 of the body proper 12 by suitable means such as a screw 19 or screws 19 and 19'. The bracket 18 has a configuration conforming to the contour of the outer periphery 13 of the body proper, and consists of a clamping portion and up-rising portions 20 extending upwards therefrom.

The operating lever 23 is supported by a pin 21 between the up-rising portions 20 of the bracket 18 and is pivotal relative to the bracket 18. The operating lever 23 has an inner end portion inserted through an opening 22 provided in the coupling portion 15 of the body proper 12 into the inner cavity 16 of the coupling portion, the inner end portion contacting a length-adjusting valve 17 provided in the body proper 12 at a point 24. The length-adjusting valve 17, if it is employed in the double-cylinder type gas spring, is adapted to bring the two chambers (not shown) into communication with each other; and to interrupt their communication with each other said two chambers consist of an inner cavity defined by an inner cylinder in the gas spring and an outer cavity defined by the inner cylinder and an outer cylinder therebetween.

In operation, when the operating lever 23 is pivoted about the pin 21 in a direction to move the outer end thereof upwards, then the inner end portion of the lever 23 will force the valve 17 down, with the aid of the pin 21 serving as a fulcrum, thereby permitting movement of a pressurized fluid within the body proper 12, whereby the seat 10 is free to vertically move for adjustment of its height.

The device according to the present invention is so constructed that the bracket carrying the operating lever 23 is tightly fastened to the outer peripheral surface of the body proper of the gas spring and the operating lever 23 is pivotally supported by the bracket 18, so that a positional relationship of the operating lever 23 relative to the length-adjusting valve 17 is maintained independent of a position of the seat 10 or the seat-supporting member 11. This contributes to solving the problems experienced with the prior art gas spring when mounted on the seat, i.e. excessive clearance or jamming of these two members due to too close positional relationship. Attaching the operating lever directly to the body proper of the gas spring makes it possible to assemble the gas spring any seat easily by placing the seat on the coupling portion 15 of the gas spring in fitted relation thereto. Thus, simplicity of assembly is one advantage of this invention. The provision of the bracket 18 fastened to the body proper of the gas spring, rather than to the seat-supporting member by welding in the prior art device, lowers production cost and thus provides an additional advantage as well as a neat external appearance.

What is claimed is:

1. In apparatus for coupling a force-receiving seat member in adjustably spaced relationship to a support device and of the kind including an elongate, adjustable length, fluid spring assembly having a cylinder body portion, fluid displacement chamber means within said body portion, a piston reciprocable within said body portion in operably coupled relationship with said fluid displacement chamber means and provided with a piston rod extending from the extremity of said body portion adjacent one end of said assembly, and a length-adjusting valve operably coupled with said fluid displacement chamber means for controlling the fluid therein to define a selected positioning for said piston and provided with a reciprocable valve operating element extending from the opposite extremity of said body portion;

means for reciprocably mounting said body portion on said support device;

means for operably coupling said piston rod with said support device;

means for mounting said force-receiving member on said assembly; and lever means shiftable into engagement with a part of said valve operating element for actuating the latter;

the improvement of which apparatus comprises:

said assembly further has adjacent the opposite end thereof a coupling portion extending from said opposite extremity of said body portion beyond said valve operating element and serving as said mounting means for said member;

said coupling portion is provided with a cavity therein for receiving the engageable part of said valve operating element and with a lateral lever-clearing opening communicating with said cavity;

there is provided bracket means including a clamping portion for embracing said body portion of said assembly, a riser portion extending from said clamping portion into externally spaced relationship to said opening for pivotally carrying said lever means and means for pivotally mounting said lever means on said riser portion; and there is provided means for tightening said clamping portion in a selected position on said body portion to mount said bracket means solely on said body portion of said assembly in spaced relationship to said member for supporting said lever means on said assembly in properly positioned operative relationship with said valve operating element and without physical engagement or mechanical connection of said bracket and said lever means with said seat member, whereby said lever means are mounted and positioned on said assembly independently of said seat member, so that said member may be mounted on said assembly in manner permitting emplacement, removal, replacement or exchange for another member without affecting the mounting and positioning of said lever means upon said assembly or the relationship of said lever means to said valve operating element.

* * * * *